US011262029B2

(12) United States Patent
Jooss

(10) Patent No.: US 11,262,029 B2
(45) Date of Patent: Mar. 1, 2022

(54) LIGHTING DEVICE HAVING SEMICONDUCTOR LIGHT SOURCE AND AT LEAST ONE INCANDESCENT FILAMENT

(71) Applicant: OSRAM Beteiligungsverwaltung GmbH, Grünwald (DE)

(72) Inventor: Sebastian Jooss, Dettingen (DE)

(73) Assignee: OSRAM Beteiligungsverwaltung GmbH, Grünwald (DE)

( * ) Notice: Subject to any disclaimer, the term of this patent is extended or adjusted under 35 U.S.C. 154(b) by 0 days.

(21) Appl. No.: 17/273,835

(22) PCT Filed: Jul. 23, 2019

(86) PCT No.: PCT/EP2019/069849
§ 371 (c)(1),
(2) Date: Mar. 5, 2021

(87) PCT Pub. No.: WO2020/048676
PCT Pub. Date: Mar. 12, 2020

(65) Prior Publication Data

US 2021/0317955 A1 Oct. 14, 2021

(30) Foreign Application Priority Data

Sep. 6, 2018 (DE) ..... 10 2018 215 128.8
Dec. 7, 2018 (DE) ..... 10 2018 221 236.8

(51) Int. Cl.
*F21S 41/14* (2018.01)
*F21K 9/232* (2016.01)
(Continued)

(52) U.S. Cl.
CPC ..... *F21K 9/232* (2016.08); *F21K 9/235* (2016.08); *F21S 41/13* (2018.01); *F21S 41/148* (2018.01);
(Continued)

(58) Field of Classification Search
CPC ..... F21S 41/18; F21S 41/141; F21S 41/162; F21S 10/023; F21Y 2113/00; F21L 4/025
See application file for complete search history.

(56) References Cited

U.S. PATENT DOCUMENTS 4,947,291 A * 8/1990 McDermott ..... F21L 14/023 362/19
4,963,798 A 10/1990 McDermott
(Continued)

FOREIGN PATENT DOCUMENTS

DE 19 618 430 A1 11/1996
DE 10 247 677 A1 4/2004
(Continued)

OTHER PUBLICATIONS

Dinka, Remko, International Search Report and Written Opinion of the International Searching Authority, for counterpart application PCT/EP2019/069849, dated Nov. 4, 2019, European Patent Office, Rijswijk, The Netherlands, 5 pages.
(Continued)

*Primary Examiner* — Ismael Negron
(74) *Attorney, Agent, or Firm* — Edward S. Podszus

(57) ABSTRACT

A lighting device includes at least one semiconductor light source, at least one incandescent filament configured to emit electromagnetic radiation when energized, and a carrier supporting both the semiconductor light source and the incandescent filament. A screen is defined by the carrier between the semiconductor light source and the incandescent filament, so as to shield the semiconductor light source from the electromagnetic radiation emitted by the incandescent filament. The incandescent filament connected in series with the at least one semiconductor light source.

20 Claims, 8 Drawing Sheets

(51) Int. Cl.

| | |
|---|---|
| ***F21K 9/235*** | (2016.01) |
| ***F21S 45/60*** | (2018.01) |
| ***F21S 41/13*** | (2018.01) |
| ***F21S 41/162*** | (2018.01) |
| ***F21S 41/148*** | (2018.01) |
| ***F21S 45/47*** | (2018.01) |
| *F21Y 115/10* | (2016.01) |

(52) U.S. Cl.
CPC ..... *F21S 41/162* (2018.01); *F21S 45/47* (2018.01); *F21S 45/60* (2018.01); *F21Y 2115/10* (2016.08)

(56) References Cited

U.S. PATENT DOCUMENTS 5,984,494 A * 11/1999 Chapman ..... B64D 47/04 362/240
7,093,956 B2 * 8/2006 Miller ..... A01M 29/10 119/200
7,116,061 B2 * 10/2006 Kim ..... F21V 23/0421 315/200 A
7,476,002 B2 * 1/2009 Wolf ..... H01J 5/54 362/231
8,044,599 B2 * 10/2011 Chang ..... F21S 4/10 315/192
2006/0092635 A1 * 5/2006 Schaak ..... F21S 6/001 362/236
2006/0146527 A1 * 7/2006 VanderSchuit ..... H05B 35/00 362/228
2006/0238136 A1 * 10/2006 Johnson, III ..... H05B 35/00 315/185 R
2007/0018594 A1 * 1/2007 Janning ..... H05B 47/23 315/312
2007/0076426 A1 * 4/2007 Kling ..... H01K 1/34 362/555
2007/0268150 A1 * 11/2007 Fraser ..... F21L 4/025 340/815.63
2019/0174602 A1 * 6/2019 Albrecht ..... H05B 45/00

FOREIGN PATENT DOCUMENTS

| | | |
|---|---|---|
| DE | 10 2013 102 203 A1 | 9/2014 |
| DE | 10 2016 206 316 A1 | 10/2017 |
| EP | 1 416 774 A1 | 5/2004 |
| JP | 2004 296212 A | 10/2004 |

OTHER PUBLICATIONS

Machine translation of JP2004-296212 A available from public espacenet database at epo.org, 16 pp.

* cited by examiner

LIGHTING DEVICE HAVING SEMICONDUCTOR LIGHT SOURCE AND AT LEAST ONE INCANDESCENT FILAMENT

CROSS-REFERENCE TO RELATED APPLICATION

The present application is a national stage entry according to 35 U.S.C. § 371 of PCT application No. PCT/EP2019/069849 filed on Jul. 23, 2019, which claims priority from German Patent Application Ser. No. 10 2018 215 128.8, which was filed Sep. 6, 2018 and from German Patent Application Ser. No. 10 2018 221 236.8, which was filed Dec. 7, 2018; each of which are incorporated herein by reference in their entirety and for all purposes.

TECHNICAL FIELD

The invention relates to a lighting device having at least one semiconductor light source, which is provided in particular as a light source for a vehicle.

SUMMARY OF THE INVENTION

The object of the invention is to provide a lighting device having at least one semiconductor light source which ensures sufficient limiting of the current through the at least one semiconductor light source during the operation of the at least one semiconductor light source with increasing supply voltage.

This object is achieved by means of a lighting device having the features from claim 1. Particularly advantageous configurations of the invention are disclosed in the dependent claims.

The lighting device according to the invention has at least one semiconductor light source and at least one electrical resistance element comprising at least one incandescent filament or embodied as an incandescent filament and connected in series with the at least one semiconductor light source. The at least one incandescent filament of the at least one electrical resistance element serves as an electrical series resistor for the at least one semiconductor light source and enables the regulation range for the supply voltage or the supply current of the at least one semiconductor light source to be increased. In particular, the at least one incandescent filament of the at least one resistance element can be used for limiting the current through the at least one semiconductor light source at a high operating temperature. Preferably, the at least one electrical resistance element is embodied as an incandescent filament.

Advantageously, the at least one incandescent filament of the at least one electrical resistance element in accordance with one or more exemplary embodiments of the invention is embodied as an infrared emitter or as a light source. As a result, the at least one incandescent filament can still be used for a further application. By way of example, in the case of use in a vehicle, it can be used for deicing a vehicle headlight or as an additional light source in the vehicle, specifically even in the switched-off state of a vehicle. Moreover, the electrical resistance element can be fitted to a cover lens of a vehicle headlight, for example of a front headlight or of a rear light, and/or can be integrated directly into the lens and thus used for heating the cover lens (defogging effect, antifogging device).

In accordance with one or more exemplary embodiments of the invention, the at least one electrical resistance element comprises a plurality of incandescent filaments connected in parallel, which are drivable or usable separately from one another. This enables a more accurate coordination of the series resistance value for the at least one semiconductor light source. A combination of series and parallel connections of a plurality of electrical resistance elements is also conceivable.

The visible light emitted by the electrical resistance elements or incandescent filaments can have a color temperature in the range of from a few 100 kelvins (K) to a few thousand kelvins, for example, up to 3450 K.

In accordance with one or more exemplary embodiments of the invention, the incandescent filament of the at least one electrical resistance element has a plurality of filament segments of identical or different lengths, which are drivable or usable separately from one another. This likewise enables a more accurate coordination of the series resistance value for the at least one semiconductor light source. Instead of an incandescent filament, it is also possible to use an incandescent wire or an incandescent foil produced from doped tungsten or tungsten-rhenium, for example, or else a heating filament composed of molybdenum disilicide ($MoSi_2$) material.

In accordance with one or more exemplary embodiments of the invention, the at least one electrical resistance element is embodied as an incandescent lamp. That enables simplified mounting and electrical contacting of the at least one electrical resistance element since the base contacts of the incandescent lamp can be used for this purpose.

In accordance with one or more exemplary embodiments of the invention, the at least one semiconductor light source and the at least one electrical resistance element are arranged on a common carrier. This simplifies mounting and contacting of the at least one semiconductor light source and of the at least one electrical resistance element. By way of example, the contacting can be carried out by means of electrical contact pads and conductor tracks arranged on a surface of the carrier.

In accordance with one or more exemplary embodiments of the invention, a screen is arranged between the at least one semiconductor light source and the at least one electrical resistance element, said screen being embodied in such a way that the at least one semiconductor light source is shielded by the screen against the electromagnetic radiation emitted by the incandescent filament.

In accordance with one or more exemplary embodiments of the invention, the screen is advantageously formed by the common carrier in order to save costs for an additional component.

In accordance with one or more exemplary embodiments of the invention, the at least one semiconductor light source and the at least one electrical resistance element are arranged on different sides, for example on the front side and rear side, of the common carrier. As a result, the carrier can be used as a screen in the simplest possible manner.

In accordance with one or more exemplary embodiments of the invention, the common carrier has two carrier sections angled away from one another and the at least one semiconductor light source is arranged on a first carrier section and the at least one electrical resistance element is arranged on a second carrier section angled away from the first carrier section. As a result, the common carrier can likewise be used as a screen in a simple manner.

In accordance with one or more exemplary embodiments of the invention, the common carrier is embodied as a heat sink. This enables cooling of the at least one semiconductor light source and of further electrical components used for the operation of the at least one semiconductor light source.

Advantageously, the at least one resistance element is embodied in such a way that it has a current-voltage characteristic curve having a first range, in which a cold resistance of the incandescent filament is effective, and a second range, which is adjacent to the first range and in which a hot resistance of the incandescent filament is effective. As a result, different resistance ranges of the incandescent filament can be used for voltage regulation or current regulation of the at least one semiconductor light source.

Preferably, the lighting device according to the invention is embodied in such a way that the transition from a cold resistance to a hot resistance of the series circuit formed by the at least one semiconductor light source and the at least one resistance element is effected during the operation of the lighting device with a rated current or a rated voltage. As a result, the comparatively high hot resistance of the incandescent filament of the at least one resistance element can be used to increase the regulation range of the supply voltage for the series circuit comprising at least one semiconductor light source and at least one resistance element.

In accordance with one or more exemplary embodiments of the invention, the lighting device has at least one switching element which bridges the at least one semiconductor light source or the at least one resistance element. This measure makes it possible to operate the incandescent filament of the at least one resistance element separately from the at least one semiconductor light source. In particular, this enables the incandescent filament to be used independently of the at least one semiconductor light source as a light source or as an infrared emitter. Moreover such a switching element makes it possible to switch the current flow through the LED only when the filament has already become hot, in order to protect the LED against an overload.

In accordance with one or more exemplary embodiments of the invention, provision is made for a pulse width modulation drive for the at least one switching element, such that an electrical current through the at least one semiconductor light source is controllable by means of pulse width modulation or similar dimming methods. As a result, the electrical power consumption of the at least one semiconductor light source can be regulated. The switching frequency of the switching element is preferably greater than 100 Hz; by way of example, it is in the range of 100 Hz to 200 Hz. Alternatively, it can also be in the range of a few kilohertz.

In accordance with one or more exemplary embodiments of the invention, the lighting device has a plurality of semiconductor light sources and the at least one electrical resistance element is connected in series with the semiconductor light sources. By way of the number of semiconductor light sources, for example, the brightness of the light emitted by the lighting device can be controlled or an adaptation of the available electrical voltage or of the available electrical current to the operating current or operating voltage required for the operation of the semiconductor light sources can be effected.

In accordance with one or more exemplary embodiments of the invention, the semiconductor light sources of the lighting device comprise a first group of semiconductor light sources connected in series with one another and a second group of semiconductor light sources connected in series with one another. Different lighting functions can be realized with the aid of the aforementioned first and second groups of semiconductor light sources.

In accordance with one or more exemplary embodiments of the invention, the first group of semiconductor light sources connected in series with one another is connected into a parallel branch with respect to the second group of semiconductor light sources connected in series with one another. As a result, the first group of semiconductor light sources can be driven and operated independently of the second group of semiconductor light sources. In particular, it is possible for the semiconductor light sources of the first group of semiconductor light sources to be switched on and switched off and optionally also dimmed independently of the semiconductor light sources of the second group of semiconductor light sources. Advantageously, the semiconductor light sources of the first and second groups of semiconductor light sources can be used for different lighting functions. By way of example, the semiconductor light sources of the first group of semiconductor light sources can be used for a first lighting function and the semiconductor light sources of the second group of semiconductor light sources can be used for a second lighting function. By way of example, in this case, the first lighting function can be a low beam and the second lighting function can be a high beam for a motor vehicle. Alternatively, it is also possible to use the semiconductor light sources of the first group of semiconductor light sources for a first lighting function and the semiconductor light sources of both the groups of semiconductor light sources jointly for a second lighting function. By way of example, in this case, the first lighting function can be a daytime running light and the second lighting function can be a low beam for a motor vehicle.

Furthermore, it is also possible to realize a first or second lighting function by means of the alternative operation of the first or second group of semiconductor light sources and a third lighting function by means of the joint operation of both groups of semiconductor light sources. By way of example, in this case, the first lighting function can be a daytime running light, the second function can be a low beam and the third function can be a high beam for a motor vehicle.

The lighting device according to the invention can additionally have further semiconductor light sources or further groups of semiconductor light sources connected in series with the at least one resistance element, in order to realize further lighting functions, for example.

In accordance with one or more exemplary embodiments of the invention, the lighting device is embodied as a retrofit lamp having a base compatible with a base of an incandescent lamp or a discharge lamp, such that the retrofit lamp as replacement for an incandescent lamp or discharge lamp can be inserted into a mount of a luminaire, in particular a vehicle luminaire, corresponding to the base and can be operated. The at least one resistance element can be embodied as an incandescent filament which emits light during operation.

In accordance with one or more exemplary embodiments of the invention, the retrofit lamp has a light-transmissive lamp vessel and the at least one semiconductor light source and the at least one resistance element are arranged within the lamp vessel. The lamp vessel offers the components of the lighting device enclosed therein protection against touch and oxidation.

In accordance with one or more exemplary embodiments of the invention, a reflector is arranged between the at least one resistance element and the at least one semiconductor light source, said reflector being embodied in such a way that infrared radiation emitted by the at least one resistance element or by the incandescent filament or light emitted by the incandescent filament is reflected away from the at least one semiconductor light source. This prevents the at least one semiconductor light source from being heated up by the electromagnetic radiation emitted by the incandescent filament.

The lighting device according to the invention is preferably provided as part of a vehicle luminaire. In particular, the retrofit lamp according to the invention is preferably embodied as a vehicle lamp.

BRIEF DESCRIPTION OF THE DRAWINGS

The invention is explained in greater detail below on the basis of preferred exemplary embodiments. In the figures:

FIGS. 1 and 2 schematically illustrate a lighting device 1000 in accordance with the first exemplary embodiment of the invention. Said lighting device 1000 has an angled metallic carrier 1010, for example composed of aluminum or sheet steel, having a first carrier section 1011 and a second carrier section 1012, which forms for example a right angle with the first carrier section 1011. A semiconductor light source arrangement 1040 having a plurality of semiconductor light sources and components 1050 of a circuit arrangement for operating the semiconductor light source arrangement 1040 and also an electrical conductor track structure 1030 for the power supply of the semiconductor light source arrangement 1040 and the integrated circuit arrangement 1050 are arranged on the front side 1011A of the first carrier section 1011. The aforementioned components 1050 of the circuit arrangement can be embodied as an integrated circuit (IC), for example. Three semiconductor light source arrangements 1040 are illustrated, but the number can be higher, for example in the range of 5 to 100 light emitting diodes (LEDs). Alternatively or additionally, chip-on-board (COB) LED luminous units, laser diodes, infrared laser diodes, and OLED luminous segments are also usable. Furthermore, matrix LED arrangements, such as the OSRAM Eviyos light source having 1024 individual luminous areas, are usable. Furthermore, micro(p)-LED arrangements consisting of a multiplicity of μLEDs, for example greater than 1000, wherein each μLED has a luminous area of approximately 2500 $\mu m^2$, are usable. It is thus possible to produce even powerful LED retrofit lamps, such as H4 retrofit or H7 retrofit lamps, and planar luminous units. The diversity of usable light sources permits a variety of applications in a vehicle headlight, for example as a light source for low beam, high beam, adaptive high beam, adaptive cornering light, rear light, signal or flashing light, for example in the frequency range of 0.1 to 10 Hz, brake light, daytime running light, fog light, decorative light, exterior lighting of the vehicle bodywork, interior lighting of the passenger compartment, and many more.

Figure 1:
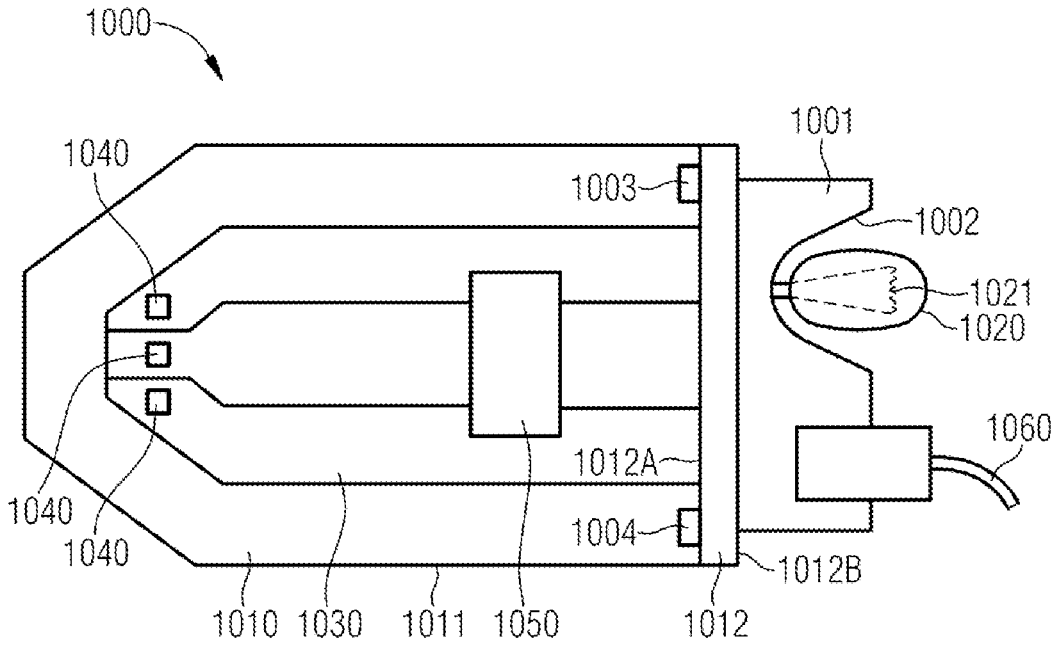
FIG. 1 shows a plan view of the lighting device in accordance with a first exemplary embodiment of the invention in a schematic illustration.

In particular, the at least one incandescent filament of the at least one resistance element can be used for limiting the current through the at least one semiconductor light source, thus for example during flashing operation or when switching from the low beam mode to the high beam mode.

Depending on the manner of operation and the application, in the case of a resistance element consisting of incandescent filaments connected in parallel, the respective segments can be connected in or disconnected.

Suitable incandescent filaments can have for example operating voltages of between 13.5 V and 28 V and powers of between 5 W and 12.5 W. The length of the filament wire can be in the range of 200 mm to 350 mm, and the length of the coiled luminous body can be in the range of 5 mm to 12 mm.

The lighting device 1000 comprises a plurality of securing pins 1003, 1004, 1005, which project from the front side 1012A of the second carrier section 1012 and serve for adjusting and fixing the lighting device 1000 in relation to a mount or holder in a vehicle luminaire. In addition, the lighting device 1000 has a receptacle 1001—arranged at the rear side 1012B of the second carrier section 1012—for an incandescent lamp 1020—having at least one incandescent filament 1021—and an electrical connection cable 1060 for supplying energy to the lighting device 1000. Alternatively, a plug can also be used instead of the connection cable 1060.

The carrier 1010 consists for example of aluminum or sheet steel or some other material that ensures a high mechanical stability and good thermal conductivity. The carrier 1010 serves for holding and as a heat sink for the semiconductor light source arrangement 1040 and the integrated circuit arrangement 1050.

The semiconductor light sources of the semiconductor light source arrangement 1040 are embodied as light emitting diodes or as laser diodes that emit white light during operation. Only three semiconductor light sources of the semiconductor light source arrangement 1040 are illustrated in schematic FIG. 1. However, the lighting device 1000 can also have more than three semiconductor light sources. The semiconductor light sources of the semiconductor light source arrangement 1040 can be for example light emitting diodes or laser diodes which generate blue light and which are provided with phosphor that converts blue light partially into light having a longer wavelength, such that overall white light that is a mixture of blue light, so-called excitation light, and light converted by the phosphor, so-called conversion light, is emitted. Alternatively, the semiconductor light sources can also be embodied as triplets of light emitting diodes, wherein each triplet has in each case one light emitting diode that emits red light, one light emitting diode that emits green light and one light emitting diode that emits blue light, such that each triplet of light emitting diodes generates white light.

The components 1050 of the circuit arrangement 1050 are embodied for example as an integrated circuit IC and comprise for example driver circuits or/and a driving device for operating the semiconductor light sources of the semiconductor light source arrangement 1040.

The electrical conductor track structure 1030 is embodied for example as a mounting circuit board or as a metal-core circuit board or as an FR4 printed circuit board or as a lead frame and includes metallic contacts and also metallic conductor tracks for contacting and supplying energy to the semiconductor light sources of the semiconductor light source arrangement 1040 and the integrated circuit arrangement 1050.

The incandescent lamp 1020 is arranged in the receptacle 1001 at the rear side 1012B of the second carrier section 1012. The receptacle 1001 is equipped with a mount for mounting and supplying energy to the incandescent lamp 1020. Moreover, the receptacle 1001 comprises a reflector 1002 for the light emitted by the incandescent filament 1021 of the incandescent lamp 1020. The incandescent filament 1021 fulfils two different tasks. It serves firstly as an electrical series resistor for the semiconductor light sources of the semiconductor light source arrangement 1040 and secondly as a light source for realizing a further lighting function or as an infrared emitter that is usable jointly with the semiconductor light sources of the semiconductor light source arrangement 1040 or else independently of the semiconductor light sources. The second carrier section 1012 of the carrier 1012 serves as a screen. It shields the semiconductor light source arrangement 1040 against the light emitted by the incandescent lamp 1020 and against the infrared radiation emitted by the incandescent lamp 1020. The incandescent lamp 1020 is for example an incandescent lamp of the ECE category W5W or W16W or P21W, but other lamp types, for example a T10 glass base lamp or a C5W festoon lamp, can also be used. The incandescent filament 2021 is embodied for example as a single filament or double filament and consists for example of tungsten wire. The lamp vessel of the incandescent lamp can be doped or provided with light absorbing or light varying materials (such as phosphors or optical elements) and/or with an at least partly light absorbing coating, for example a dichroic coating or a thin color covering.

In an embodiment that is not illustrated here, the resistance element or the incandescent lamp 1020 is completely integrated into the receptacle 1001 or enclosed by it, preferably in a hermetically sealed manner, such that from the outside it is no longer visible and is protected from environmental influences.

Figure 3:
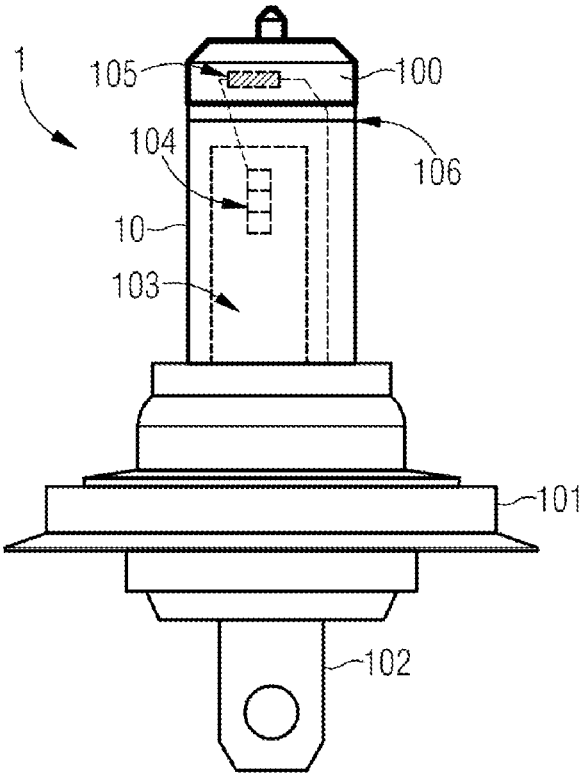
FIG. 3 shows a side view of a lighting device embodied as a retrofit lamp in accordance with the second exemplary embodiment of the invention in a schematic illustration.

FIG. 3 schematically illustrates a retrofit lamp 1 for a vehicle headlight in accordance with the second exemplary embodiment of the invention. This retrofit lamp 1 has a light-transmissive lamp vessel 10 made of glass having a light-nontransmissive lamp vessel section 100 arranged at the lamp vessel dome, and a lamp base 101, in which the end of the lamp vessel 10 facing away from the lamp vessel dome 100 is arranged. The lamp base 101 is equipped with electrical contacts 102 for supplying energy to the retrofit lamp 1. The lamp vessel 10 encloses a semiconductor light source arrangement 104 mounted on a cooling body 103. The semiconductor light source arrangement 104 consists of a plurality of semiconductor light sources LD1, LD2 to LDn arranged in a series, wherein n denotes a natural number greater than two. Only three semiconductor light sources are illustrated in FIG. 3. The semiconductor light sources of the semiconductor light source arrangement 104 are light emitting diodes that emit white light. An incandescent filament 105 is arranged in the region of the light-nontransmissive lamp vessel dome 100. The incandescent filament 105 serves as a series resistor for the light emitting diodes and as an infrared emitter. A reflector 106 for infrared radiation is arranged in a region between the incandescent filament 105 and the cooling body 103 with the semiconductor light source arrangement 104 mounted thereon, said reflector reflecting infrared radiation emitted by the incandescent filament 105 away from the semiconductor light source arrangement 104. The cooling body 103 is embodied as a heat conductor (e.g. as a heat sink or a heat pipe) and dissipates the heat generated by the semiconductor light source arrangement 104 toward the outside for example via the lamp base 101 and the electrical contacts 102.

Figure 2:
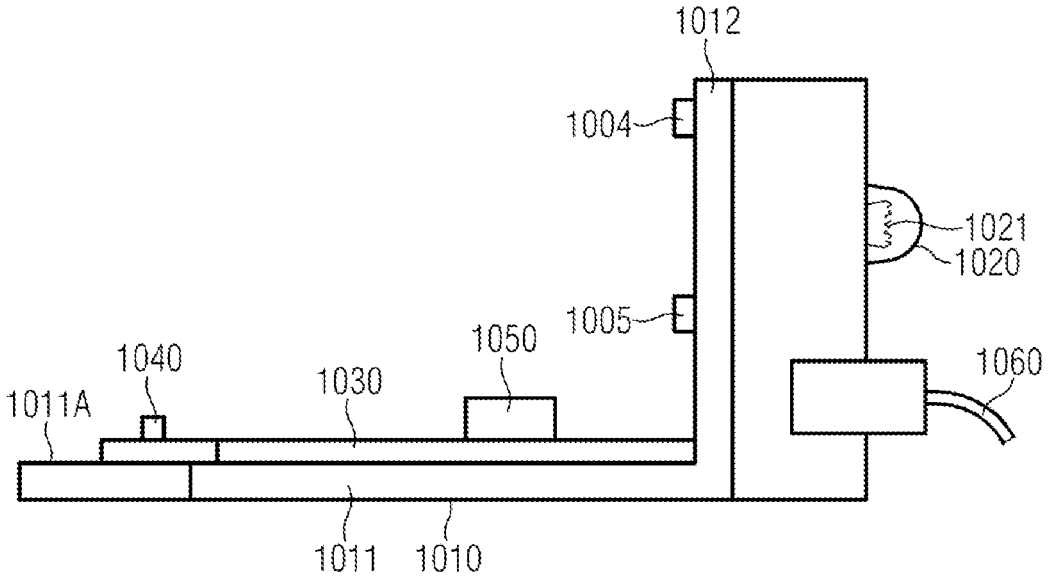
FIG. 2 shows a side view of the lighting device depicted in FIG. 1.
Figure 4:
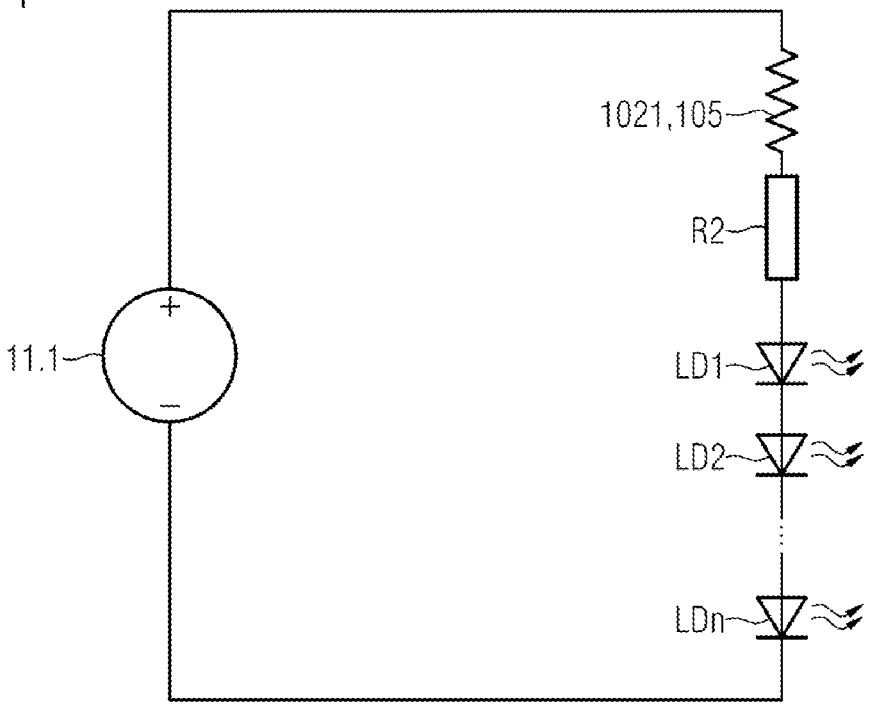
FIG. 4 shows a schematic illustration of a circuit arrangement for operating the lighting device or retrofit lamp depicted in FIGS. 1 to 3.

FIG. 4 schematically illustrates a circuit arrangement which is usable both for the operation of the lighting device 1000 depicted in FIGS. 1 and 2 and for the operation of the retrofit lamp 1 depicted in FIG. 3. Said circuit arrangement comprises the incandescent filament 1021 or 105 of the lighting device 100 or respectively of the retrofit lamp 1, an optional ohmic resistor R2 and the semiconductor light sources LD1, LD2 to LDn of the semiconductor light source arrangement 1040 or 104 of the lighting device 1000 or respectively of the retrofit lamp 1, and also a DC voltage source U1.

The incandescent filament 1021 or 105, the optional ohmic resistor R2 and the semiconductor light sources LD1, LD2 to LDn are connected in series, such that the same current flows through these components during operation. The incandescent filament serves as an electrical series resistor for the semiconductor light sources LD1, LD2 to LDn. The optional ohmic resistor R2 serves for finer coordination and for current limiting, in particular for surge current limiting.

Figure 5:
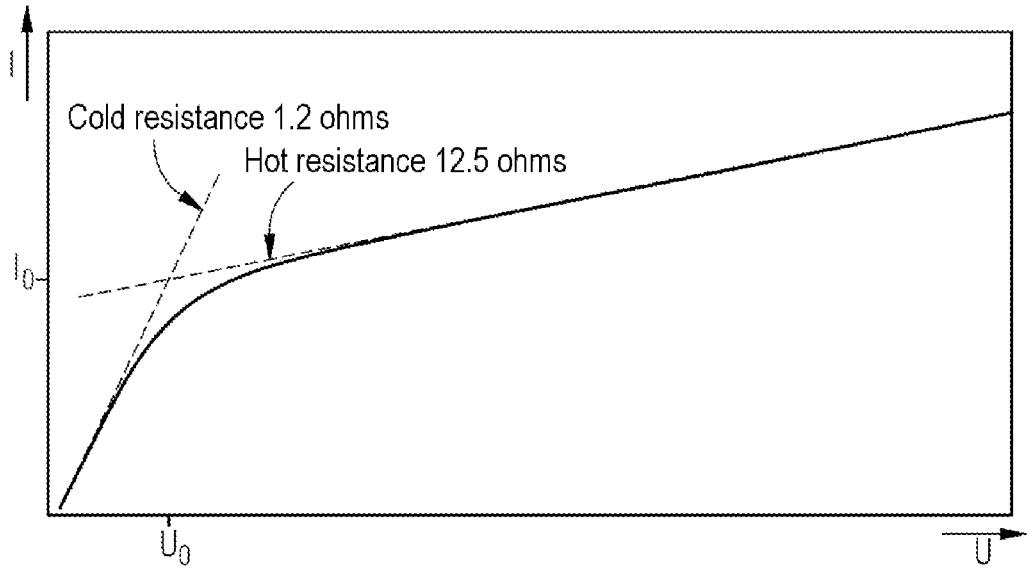
FIG. 5 shows a schematic illustration of a current-voltage characteristic curve of an incandescent filament, wherein, in arbitrary units, the voltage U is plotted on the horizontal axis and the current I is plotted on the vertical axis, and the two straight lines show the cold resistance and respectively hot resistance of the incandescent filament, and wherein the point $U_0$, $I_0$ denotes the transition region from the cold resistance to the hot resistance.

FIG. 5 schematically illustrates the current-voltage characteristic curve of the incandescent filament 1021 or 105 of the lighting device 1000 or respectively of the retrofit lamp 1. The two straight lines drawn in a dashed manner and running tangentially with respect to the characteristic curve show the cold resistance and respectively the hot resistance of the incandescent filament 1021 or 105. The gradient of the aforementioned straight lines corresponds in each case to the reciprocal of the differential resistance of the incandescent filament at the tangency point of the straight lines to the current-voltage characteristic curve. The value pair $U_0$, $I_0$ denotes the transition region from the cold resistance to the hot resistance of the incandescent filament 1021 or 105.

By way of example, the incandescent filament of an incandescent lamp of the ECE category WSW, designed for a power of 5 watts at a voltage of 12 volts, has a hot resistance of 35.0 ohms and a cold resistance of 2.6 ohms. The incandescent filament of an incandescent lamp of the ECE category W16W, designed for a power of 16 watts at a voltage of 12 volts, has a hot resistance of 9.3 ohms and a cold resistance of 0.6 ohm. The incandescent filament of an incandescent lamp of the ECE category P21W, designed for a power of 21 watts at a voltage of 24 volts (DC voltage), has a hot resistance of 28.3 ohms and a cold resistance of 1.6 ohms. The aforementioned incandescent filaments can serve for example as a series resistor for the semiconductor light source arrangement 1040 of the lighting device 1000. The hot resistance or differential hot resistance of the respective incandescent filament mentioned above is effective during the operation of the incandescent filament with greater than or equal to 2 volts (DC voltage). The cold resistance or differential cold resistance is effective during the operation of the incandescent filament with a voltage of less than or equal to 1 volt (DC voltage). The transition from the cold resistance to the hot resistance or differential hot resistance is effected in the range of approximately 1 to 2 volts (DC voltage).

Figure 6:
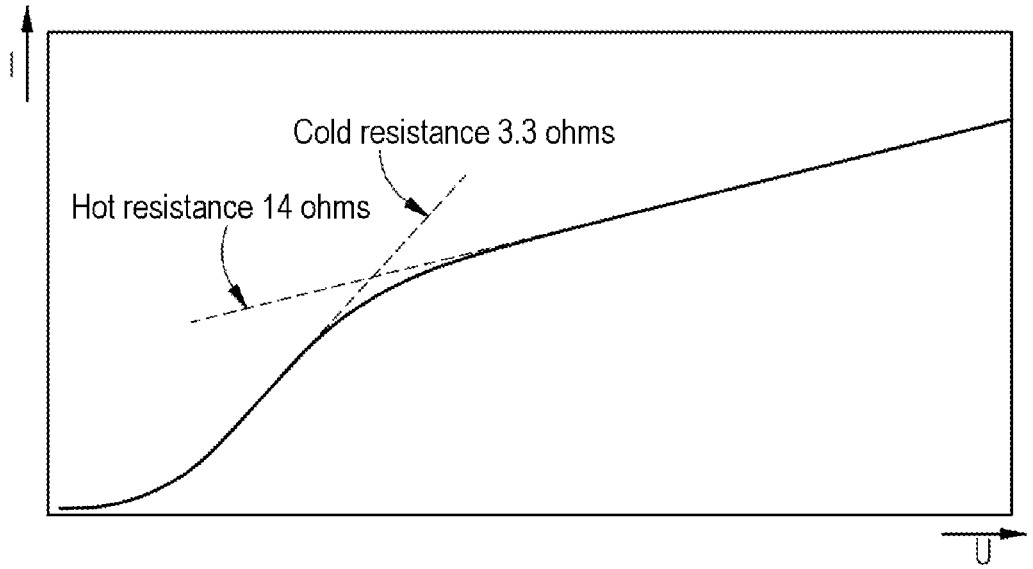
FIG. 6 shows a schematic illustration of the current-voltage characteristic curve of the series circuit formed by the incandescent filament 1021 or 105 and the semiconductor light sources LD1 to LDn of the lighting device or retrofit lamp depicted in FIGS. 1 to 3 with the circuit arrangement depicted in FIG. 4 for operating the lighting device or retrofit lamp, wherein, in arbitrary units, the voltage U is plotted on the horizontal axis and the current I is plotted on the vertical axis, and the two straight lines show the cold resistance and respectively hot resistance of the series circuit comprising incandescent filament and semiconductor light sources of the lighting device or retrofit lamp.

FIG. 6 schematically illustrates the current-voltage characteristic curve of the series circuit formed by the incandescent filament 1021 or 105, the optional ohmic resistor R2 and the semiconductor light sources LD1, LD2 to LDn. The two straight lines drawn in a dashed manner and running tangentially with respect to the characteristic curve show the cold resistance and respectively the hot resistance of the aforementioned series circuit. The incandescent filament 1021 or 105 is preferably embodied in such a way that the transition from the cold resistance to the hot resistance of the aforementioned series circuit is effected at a rated current or a rated voltage $U_N$ of the lighting device 1000 or respectively of the retrofit lamp 1. As a result, the current rise is relatively small at higher voltage on account of the higher hot resistance and the light emitting diodes LD1, LD2 to LDn can be operated over a larger range without the current becoming excessively high. Moreover, as a result, the current required for the operation of the light emitting diodes can already be attained at a lower voltage than with the use of an ohmic resistor, since with the use of the filament the cold resistance of the filament takes effect until the rated current is attained.

Figure 7:
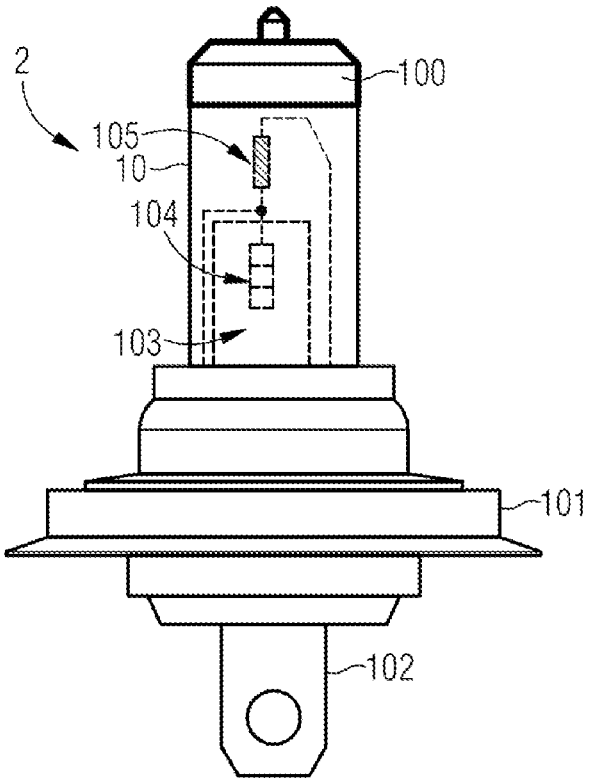
FIG. 7 shows a schematic illustration of the lighting device embodied as a retrofit lamp in accordance with the third exemplary embodiment of the invention.
Figure 8:
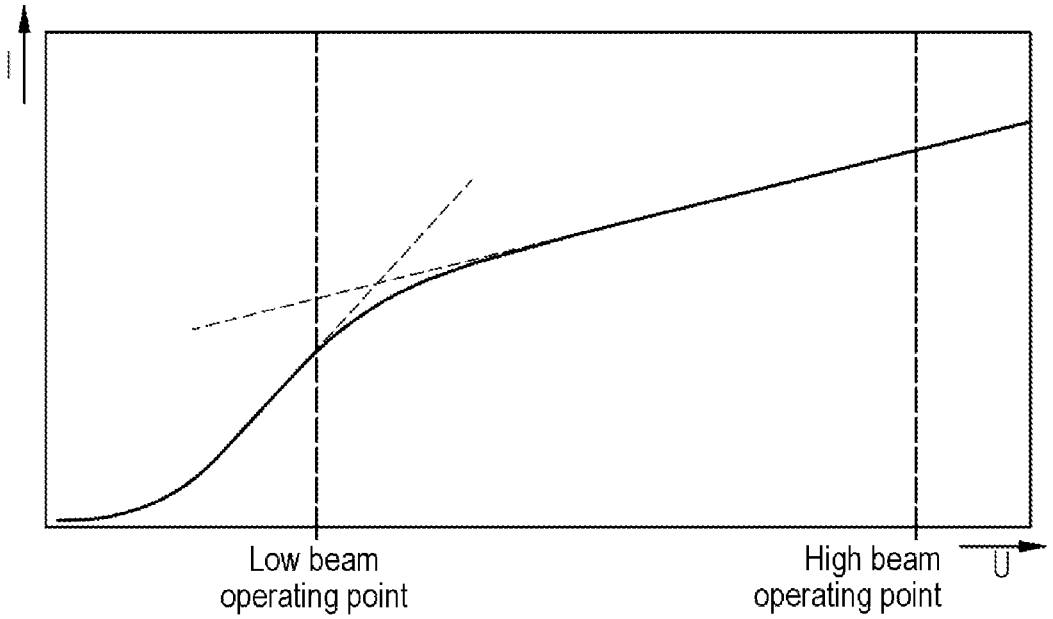
FIG. 8 shows a schematic illustration of the current-voltage characteristic curve of the series circuit formed by the incandescent filament and the semiconductor light sources of the retrofit lamp depicted in FIG. 7 with the circuit arrangement depicted in FIG. 4 for operating the retrofit lamp depicted in FIG. 7, wherein, in arbitrary units, the voltage U is plotted on the horizontal axis and the current I is plotted on the vertical axis, with different operating points for low beam operation and high beam operation of the retrofit lamp, and wherein the two straight lines drawn in a dashed manner show the cold resistance and respectively hot resistance of the retrofit lamp.

FIG. 7 schematically illustrates a retrofit lamp 2 for a vehicle headlight in accordance with the third exemplary embodiment of the invention. This retrofit lamp differs from the second exemplary embodiment of the invention merely in the positioning of the incandescent filament. Therefore, the same reference signs are used for identical components in FIGS. 3 and 7. The retrofit lamp 2 has a light-transmissive lamp vessel 10 made of glass having a light-nontransmissive lamp vessel section 100 arranged at the lamp vessel dome, and a lamp base 101, in which the end of the lamp vessel 10 facing away from the lamp vessel dome 100 is arranged. The lamp base 101 is equipped with electrical contacts 102 for supplying energy to the retrofit lamp 1. The lamp vessel 10 encloses a semiconductor light source arrangement 104 mounted on a cooling body 103. The semiconductor light source arrangement 104 consists of a plurality of semiconductor light sources LD1, LD2 to LDn arranged in a series, wherein n denotes a natural number greater than two. Only three semiconductor light sources are illustrated in FIG. 7. The semiconductor light sources LD1, LD2 to LDn are light emitting diodes that emit white light. Like the light emitting diodes, the incandescent filament 105 is likewise surrounded by a light-transmissive, hollow-cylindrical section of the lamp vessel 10. The incandescent filament serves as a series resistor for the light emitting diodes and for generating light. A high beam light distribution can be generated by means of the incandescent filament, in interaction with the light emitting diodes. A low beam light distribution can be generated by means of the light emitting diodes, without light emission by the incandescent filament. The retrofit lamp 2 in accordance with the second exemplary embodiment of the invention is operated for example with the circuit arrangement depicted in FIG. 4. The operating points of the circuit arrangement in accordance with FIG. 4 are chosen such that for generating the low beam light distribution a voltage is applied at which only the light emitting diodes LD1, LD2 to LDn emit light and the incandescent filament 105 is in the cold resistance range, and for generating the high beam light distribution the incandescent filament 105 is operated in the hot resistance range and a correspondingly higher current is applied to the light emitting diodes. FIG. 8 schematically illustrates these two modes of operation, i.e. high beam operation and low beam operation of the retrofit lamp 2. At a voltage or current corresponding to the low beam operating point, the incandescent filament 105 does not yet emit light. Only the light emitting diodes emit light. At a voltage or current corresponding to the high beam operating point, both the light emitting diodes and the incandescent filament emit light.

Figure 9:
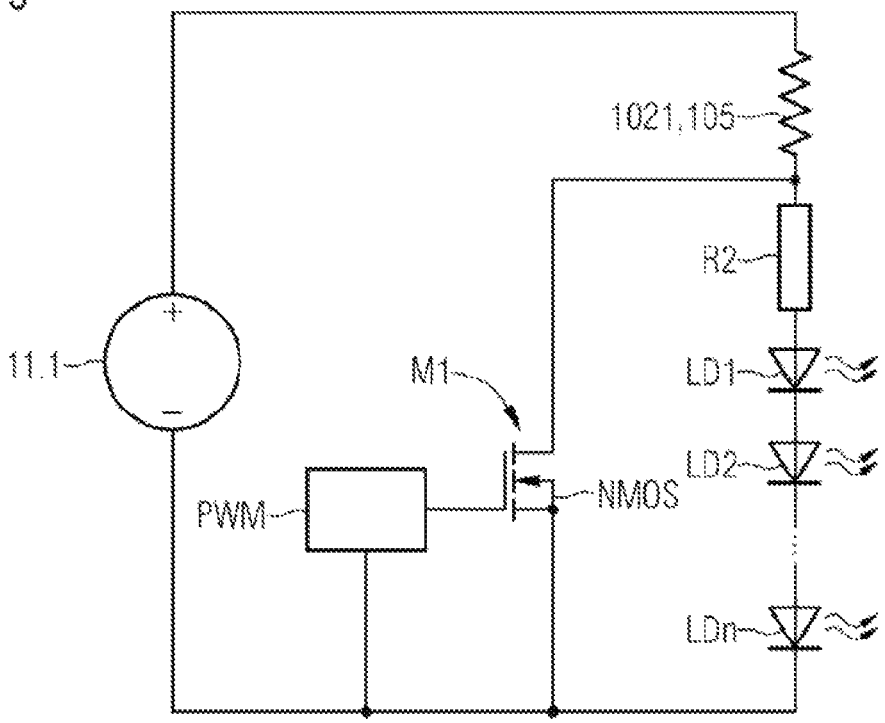
FIG. 9 shows an alternative circuit arrangement for operating the lighting devices depicted in FIGS. 1 to 3 and 7, wherein provision is made for a switch in the form of a transistor for bridging the semiconductor light sources and the optional ohmic resistor, and with pulse width modulation driving for the transistor.

FIG. 9 schematically illustrates an alternative circuit arrangement for operating the retrofit lamp 2 or the lighting device 1000, which is usable instead of the circuit arrangement depicted in FIG. 4 for operating the retrofit lamp 2 or the lighting device 1000. The circuit arrangement illustrated in FIG. 9 differs from the circuit arrangement depicted in FIG. 4 in terms of an additional switch Ml, which is embodied as an NMOS transistor, for example. Therefore, the same reference signs are used for identical components in FIGS. 4 and 9. The optional resistor R2 and the light emitting diodes LD1, LD2 to LDn can be bridged by means of the switch Ml.

Figure 10:
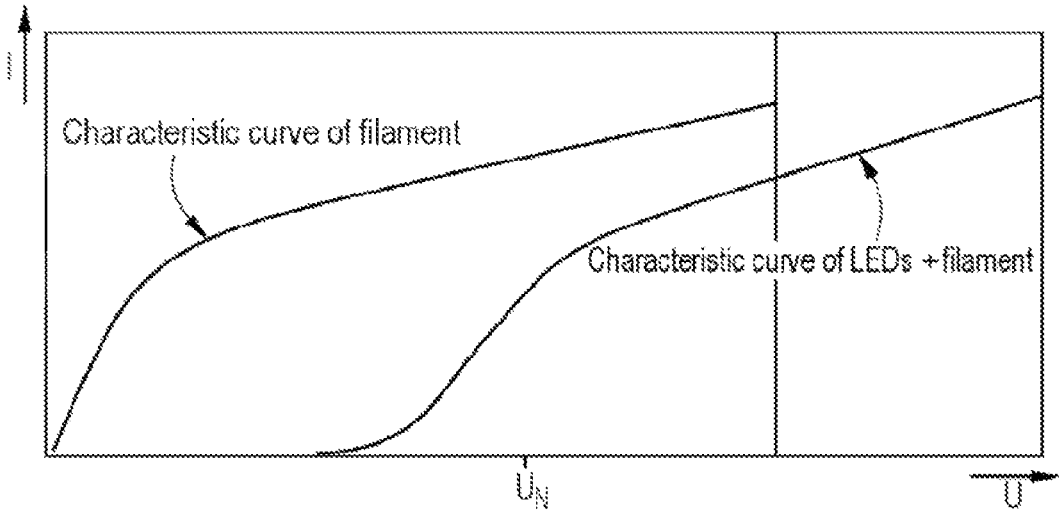
FIG. 10 shows a schematic illustration of the current-voltage characteristic curve of the series circuit formed by the incandescent filament 1021 or 105 and the semiconductor light sources LD1 to LDn of the lighting devices depicted in FIGS. 1 to 3 and 7 with the circuit arrangement depicted in FIG. 9 for operating said lighting devices, wherein, in arbitrary units, the voltage U having the value $U_N$ for the rated voltage of the lighting device is plotted on the horizontal axis and the current I is plotted on the vertical axis.

By way of example, the switch M1 can be driven such that the supply voltage of the voltage source U1 is present only at the incandescent filament 1021 or 105. As a result, only the incandescent filament contributes to the light distribution and the light emitting diodes LD1, LD2 to LDn do not emit light. In the other switching state of the switch, the current flows both through the incandescent filament 1021 or 105 and through the light emitting diodes LD1, LD2 to LDn. FIG. 10 schematically illustrates the current-voltage characteristic curve of the lighting device 1000 or of the retrofit lamp 2 for this operation with the aid of the circuit arrangement in accordance with FIG. 9.

The transistor switch M1 can also be driven by means of a pulse width modulation drive (PWM), such that the current through the series circuit formed by the optional ohmic resistor R2 and the light emitting diodes LD1, LD2 to LDn is switched on and off with the timing of the switching cycle of the transistor Ml. The switching frequency can be greater than 100 Hz or even greater than 20 kHz, for example. The switched-on duration and the switched-off duration of the transistor switch M1 and thus the current flow through the incandescent filament 1021 or 105 or through the series circuit comprising incandescent filament and light emitting diodes LD1, LD2 to LDn can be controlled by means of the pulse width modulation drive (PWM).

Figure 14:
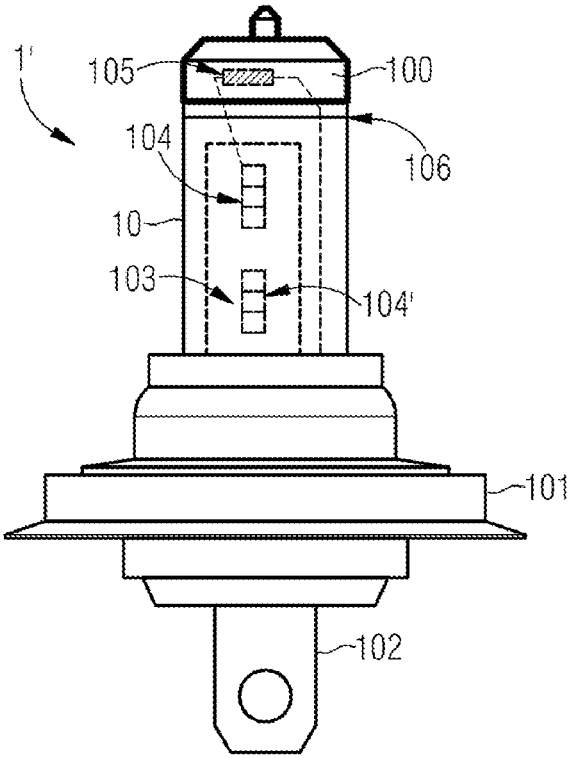
FIG. 14 shows a side view of a lighting device embodied as a retrofit lamp in accordance with the fourth exemplary embodiment of the invention in a schematic illustration.

FIG. 14 schematically illustrates a retrofit lamp 1' for a vehicle headlight in accordance with the fourth exemplary embodiment of the invention. This retrofit lamp 1' is embodied largely identically to the retrofit lamp 1 in accordance with the second exemplary embodiment depicted in FIG. 3. Therefore, the same reference signs are used for identical parts of the retrofit lamps 1 and 1' in FIGS. 3 and 14. The retrofit lamp 1' has a light-transmissive lamp vessel 10 made of glass having a light-nontransmissive lamp vessel section 100 arranged at the lamp vessel dome, and a lamp base 101, in which the end of the lamp vessel 10 facing away from the lamp vessel dome 100 is arranged. The lamp base 101 is equipped with electrical contacts 102 for supplying energy to the retrofit lamp 1'. The lamp vessel 10 encloses two semiconductor light source arrangements 104, 104' mounted on a cooling body 103. The first semiconductor light source arrangement 104 consists of a plurality of semiconductor light sources D1, D2 to Dn arranged in a series, wherein n denotes a natural number greater than two, and the second semiconductor light source arrangement 104' consists of a plurality of semiconductor light sources D1' to Dm' arranged in a series, wherein m denotes a natural number greater than two. FIG. 14 illustrates only in each case three semiconductor light sources for each semiconductor light source arrangement 104 and 104'. The semiconductor light sources of the semiconductor light source arrangements 104, 104' are light emitting diodes that emit white light. An incandescent filament 105 is arranged in the region of the light-nontransmissive lamp vessel dome 100. The incandescent filament 105 serves as a series resistor for the light emitting diodes and as an infrared emitter. A reflector 106 for infrared radiation is arranged in a region between the incandescent filament 105 and the cooling body 103 with the semiconductor light source arrangements 104, 104' mounted thereon, said reflector reflecting infrared radiation emitted by the incandescent filament 105 away from the semiconductor light source arrangements 104, 104'. The cooling body 103 is embodied as a heat conductor (e.g. as a heat sink or a heat pipe) and dissipates the heat generated by the semiconductor light source arrangements 104, 104' toward the outside for example via the lamp base 101 and the electrical contacts 102.

The semiconductor light sources D1 to Dn of the first semiconductor light source arrangement 104 form a first group of semiconductor light sources D1 to Dn connected in series with one another. The semiconductor light sources D1' to Dm' of the second semiconductor light source arrangement 104' form a second group of semiconductor light sources D1' to Dm' connected in series with one another. The semiconductor light sources D1 to Dn of the first group 104 of semiconductor light sources are connected into a parallel branch with respect to the semiconductor light sources of the second group 104' of semiconductor light sources. The semiconductor light sources D1 to Dn of the first group 104 of semiconductor light sources are operated alternatively to the semiconductor light sources D1' to Dm' of the second group 104' of semiconductor light sources. The semiconductor light sources D1 to Dn of the first group 104 of semiconductor light sources serve for generating the low beam and the semiconductor light sources D1' to Dm' of the second group 104' of semiconductor light sources serve for generating the high beam for a motor vehicle. In low beam operation, the resistance element 105 embodied as an incandescent filament is connected in series with the semiconductor light sources D1 to Dn of the first group 104 of semiconductor light sources and, in high beam operation, the resistance element 105 embodied as an incandescent filament is connected in series with the semiconductor light sources D1' to Dm' of the second group 104' of semiconductor light sources.

Figure 15:
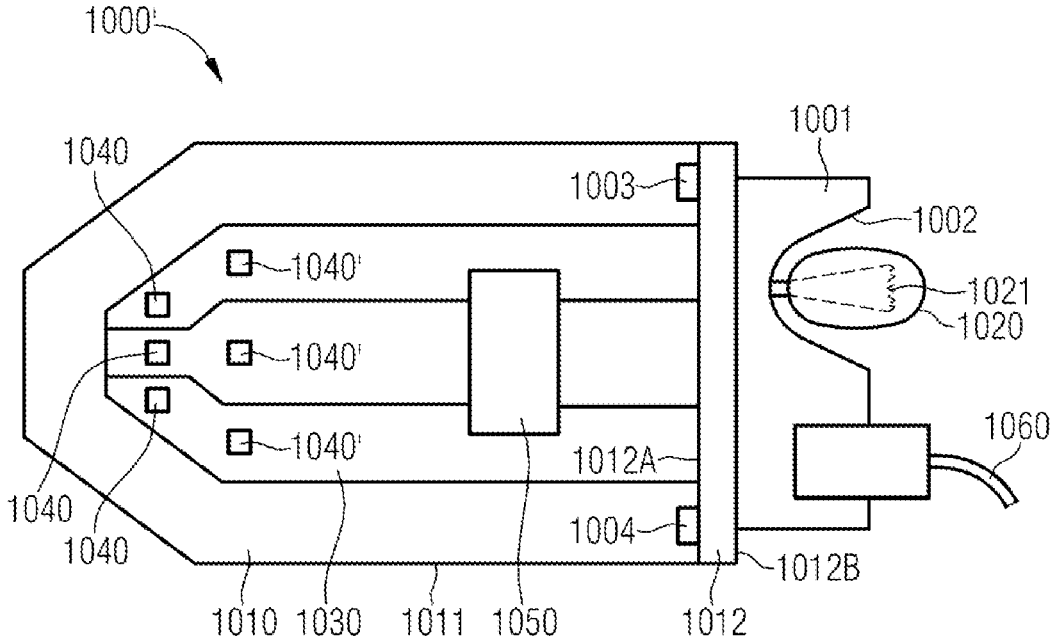
FIG. 15 shows a plan view of the lighting device in accordance with the fifth exemplary embodiment of the invention in a schematic illustration.

FIG. 15 schematically illustrates a lighting device 1000' in accordance with the fifth exemplary embodiment of the invention. This lighting device is embodied largely identically to the lighting device in accordance with the first exemplary embodiment as depicted in FIGS. 1 and 2. Therefore, the same reference signs are used for identical components of the lighting devices in FIGS. 1 and 15 and for their description reference is made to the corresponding description of the components in the first exemplary embodiment. The lighting device in accordance with the fifth exemplary embodiment of the invention differs from the lighting device in accordance with the first exemplary embodiment of the invention in that, in addition to the semiconductor light source arrangement 1040, the lighting device in accordance with the fifth exemplary embodiment also has a further semiconductor light source arrangement 1040', which arrangements are arranged on the first carrier section 1011 of the carrier 1010. The semiconductor light source arrangement 1040 forms a first group of semiconductor light sources that emit white light during operation, and the semiconductor light source arrangement 1040' forms a second group of semiconductor light sources that emit white light during operation. The first group 1040 of semiconductor light sources serves for generating a low beam and the second group 1040' of semiconductor light sources serves for generating a high beam for a motor vehicle. Alternative circuit arrangements for operating the lighting device in accordance with the fifth exemplary embodiment are illustrated schematically in FIGS. 11 to 13. In all other details the lighting device in accordance with the fifth exemplary embodiment of the invention corresponds to the lighting device in accordance with the first exemplary embodiment.

Figure 11:
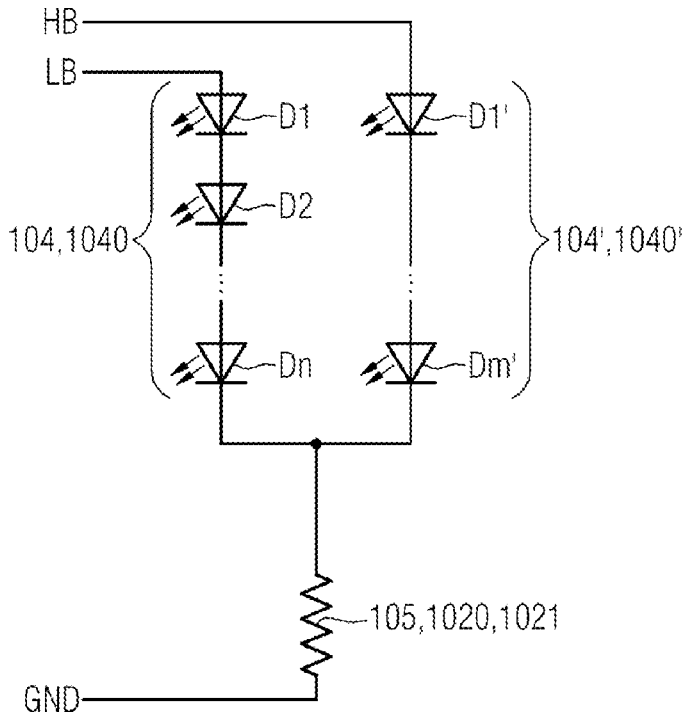
FIG. 11 shows a schematic illustration of a circuit arrangement for operating a lighting device or retrofit lamp in accordance with the fourth and fifth exemplary embodiments of the invention.

FIG. 11 schematically illustrates the circuit arrangement of the two groups 104, 104', 1040, 1040' of semiconductor light sources and of the resistance element 105, 1020 comprising an incandescent filament 1021 for the exemplary embodiments of the invention as depicted in FIGS. 14 and 15. During low beam operation, the terminal LB is connected to the positive pole of the on-board electrical system voltage of the motor vehicle and the terminal GND is connected to the negative pole of the on-board electrical system voltage or to the ground reference potential, such that the resistance element 105, 1020 comprising an incandescent filament 1021 is connected in series with the first group 104, 1040 of semiconductor light sources D1 to Dn. The first group 104, 1040 of semiconductor light sources D1 to Dn is embodied as a series circuit comprising light emitting diodes that emit white light during operation. During high beam operation, the terminal HB is connected to the positive pole of the on-board electrical system voltage of the motor vehicle and the terminal GND is connected to the negative pole of the on-board electrical system voltage or to the ground reference potential, such that the resistance element 105, 1020 comprising an incandescent filament is connected in series with the second group 104', 1040' of semiconductor light sources D1' to Dm'. The second group 104', 1040' of semiconductor light sources D1' to Dm' is embodied as a series circuit comprising light emitting diodes that emit white light during operation. The switchover between low beam operation and high beam operation is effected by means of a switch (not depicted).

Figure 12:
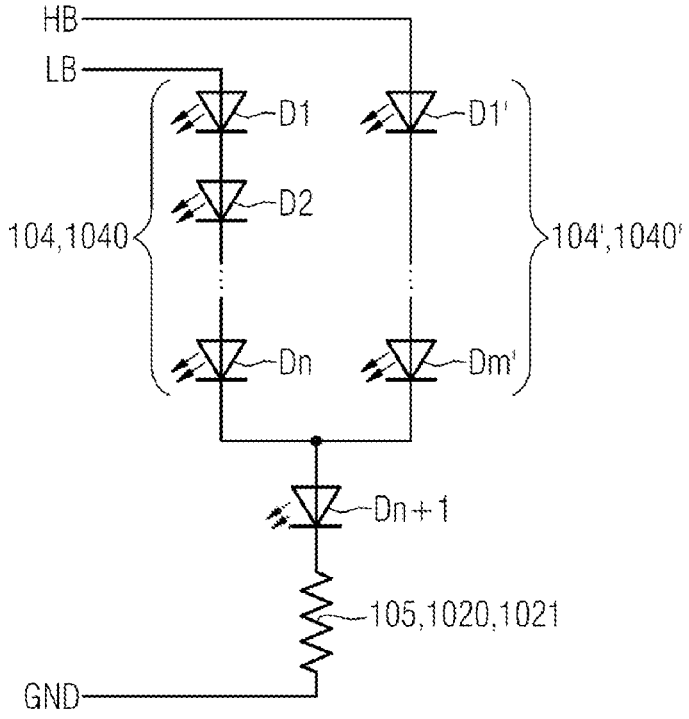
FIG. 12 shows a schematic illustration of a circuit arrangement for operating a lighting device or retrofit lamp in accordance with the sixth exemplary embodiment of the invention.

FIG. 12 schematically illustrates an alternative circuit arrangement in accordance with the sixth exemplary embodiment of the invention for the retrofit lamp depicted in FIG. 14 and for the lighting device depicted in FIG. 15. This circuit arrangement is largely identical to the circuit arrangement depicted in FIG. 11. Therefore, identical components are provided with the same reference signs in FIGS. 11 and 12. The circuit arrangement in accordance with the sixth exemplary embodiment of the invention has a light emitting diode Dn+1 which emits white light and which is used both during low beam operation and during high beam operation. That is to say that, during low beam operation, the light emitting diode Dn+1 is connected in series with the resistance element 105, 1020 and with the series circuit formed by the light emitting diodes D1 to Dn and, during high beam operation, the light emitting diode Dn+1 is connected in series with the resistance element 105, 1020 and with the series circuit formed by the light emitting diodes D1' to Dm'.

Figure 13:
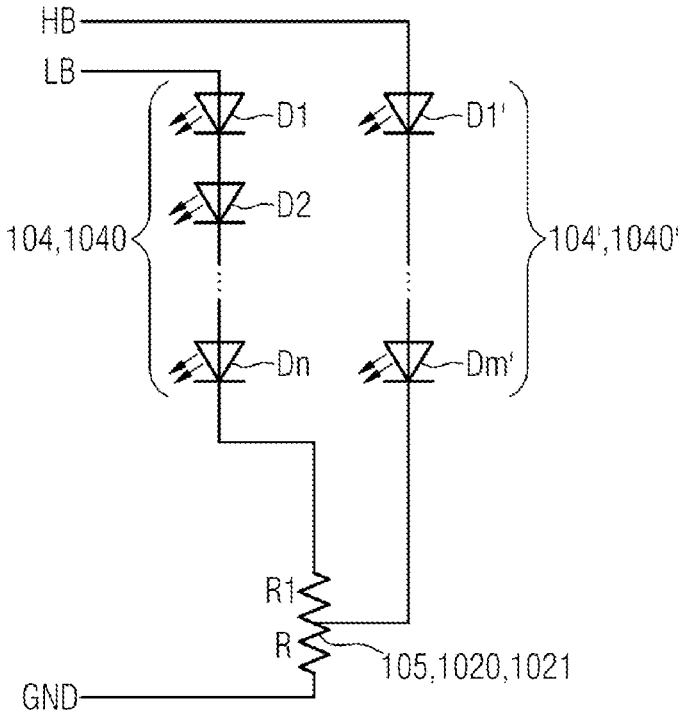
FIG. 13 shows a schematic illustration of a circuit arrangement for operating a lighting device or retrofit lamp in accordance with the seventh exemplary embodiment of the invention.

FIG. 13 schematically illustrates a further alternative circuit arrangement in accordance with the seventh exemplary embodiment of the invention for the retrofit lamp depicted in FIG. 14 and for the lighting device depicted in FIG. 15. This circuit arrangement is largely identical to the circuit arrangement depicted in FIG. 11. Therefore, identical components are provided with same reference signs in FIGS. 11 and 13. The circuit arrangement in accordance with the seventh exemplary embodiment of the invention differs from the circuit arrangement depicted in FIG. 11 in that different regions R, R1 and thus different resistance values of the resistance element 105, 1020 are effective during low beam operation and high beam operation. During low beam operation, the terminal LB is connected to the positive pole of the on-board electrical system voltage of the motor vehicle and the terminal GND is connected to the negative pole of the on-board electrical system voltage or to the ground reference potential, such that the resistance element 105, 1020 comprising an incandescent filament 1021 is connected in series with the first group 104, 1040 of semiconductor light sources D1 to Dn. Both regions R and R1 of the resistance element 105, 1020 are thus effective during low beam operation. During high beam operation, the terminal HB is connected to the positive pole of the on-board electrical system voltage of the motor vehicle and the terminal GND is connected to the negative pole of the on-board electrical system voltage or to the ground reference potential, such that only the region R of the resistance element 105, 1020 comprising an incandescent filament 1021 is connected in series with the second group 104', 1040' of semiconductor light sources D1' to Dm'. The region R1 of the resistance element 105, 1020 is not effective during high beam operation. The incandescent filament 1021 of the resistance element 105, 1020 has a center tap enabling the resistance element 105, 1020 to be divided into the regions R and R1.

The invention is not restricted to the exemplary embodiments explained in greater detail above.

By way of example, the incandescent filament 1021 or 105 can have a plurality of filament segments, which are operable independently of one another. Alternatively or additionally, instead of the incandescent filament 1021 or 105, a parallel circuit formed by a plurality of incandescent filaments, which are operable independently of one another, can be used in order to have redundancy for example in the case of interruption of a filament (emergency operation).

Furthermore—when the surroundings are at low temperatures—the incandescent filament can be preheated (increase in the thermal resistance) or the semiconductor light sources can be heated to higher temperatures by means of preheating (faster attainment of the operating temperature).

An incandescent filament can be supported by one or more holding elements (filament holders), and there can likewise be a segmented incandescent filament and also a parallel arrangement of incandescent filaments, in order to make the filament arrangement resistant to impacts and vibrations.

The light-nontransmissive coating of the lamp vessel dome can consist of various materials (e.g. silver, gold, blue or black or dichroic coating).

The interior of the lamp vessel 10 can be filled with inert gas or gas mixtures, in particular with gas fillings that are customary for incandescent lamps or halogen incandescent lamps.

By way of example, light emitting diodes which are provided with phosphor and generate blue light can be used as semiconductor light sources, wherein the phosphor converts the blue light proportionally into light of a different wavelength, such that white light that is a mixture of non-wavelength-converted light and wavelength-converted light is emitted. Alternatively, it is also possible to use RGB triplets of light emitting diodes that generate red, green and blue light, which overall produces white mixed light. The lighting device according to the invention can also have just a single semiconductor light source.

The components of the circuit arrangement for operating the semiconductor light sources can be arranged on the cooling body and/or the circuit board on which the semiconductor light sources are also arranged. Alternatively, the components of the circuit arrangement for operating the semiconductor light sources can also be arranged in the lamp base.

The lamp base of the retrofit lamp or the carrier 1010 of the lighting device 1000 can have cooling fins or ventilation holes. A fan can be arranged in the interior of the lamp base.

The wall of the light-transmissive section of the lamp vessel can have a coating that reflects infrared radiation, or can have an antireflective coating for light.

The invention claimed is:

1. A lighting device comprising:

at least one semiconductor light source;

at least one electrical resistance element comprising an incandescent filament operable, when energized, to emit electromagnetic radiation; and a common carrier on which the at least one semiconductor light source and the at least one resistance element are disposed, wherein the at least one resistance element is connected in a series circuit with the at least one semiconductor light source, and wherein a portion of the common carrier defines a screen disposed between the at least one resistance element and the at least one semiconductor light source so as to shield the at least one semiconductor light source from the electromagnetic radiation emitted by the incandescent filament.

2. The lighting device of claim 1, wherein the incandescent filament is configured as at least one of an infrared emitter a light source.

3. The lighting device of claim 1, wherein the at least one electrical resistance element is configured as an incandescent lamp.

4. The lighting device as claimed in claim 1, wherein the at least one electrical resistance element comprises a plurality of incandescent filaments connected in parallel and which are energizable separately.

5. The lighting device of claim 1, wherein the incandescent filament of the at least one electrical resistance element comprises a plurality of filament segments which are energizable separately.

6. The lighting device of claim 1, wherein the at least one semiconductor light source and the at least one resistance element are arranged on different sides of the common carrier.

7. The lighting device of claim 1, wherein the common carrier comprises a first carrier section and a second carrier section, the second carrier section being angled away from the first carrier section, the at least one semiconductor light source being arranged on the first carrier section and the at least one resistance element being arranged on the second carrier section.

8. The lighting device of claim 1, wherein the common carrier comprises a heat sink.

9. The lighting device of claim 1, wherein the at least one resistance element is embodied such that it exhibits a current-voltage characteristic curve having a first range in which a cold resistance of the incandescent filament is effective, and a second range in which a hot resistance of the incandescent filament is effective, the second range being adjacent the first range.

10. The lighting device of claim 9, wherein the lighting device is configured such that a transition from the cold resistance to the hot resistance of the series circuit formed by the at least one semiconductor light source and the incandescent filament of the at least one resistance element is effected during operation of the lighting device with a rated current or a rated voltage.

11. The lighting device of claim 1, further comprising at least one switching element which bridges the at least one semiconductor light source or the at least one resistance element.

12. The lighting device of claim 11, further comprising a pulse width modulation drive (PWM) for the at least one switching element, whereby an electrical current through the at least one semiconductor light source is controllable by pulse width modulation.

13. The lighting device of claim 1, wherein the common carrier is supported on a base whose shape corresponds to a conventional base of a vehicular incandescent or discharge lamp to thereby define a vehicular retrofit lamp interchangeably and operably receivable in a conventional socket mount of a vehicular luminaire that receives the conventional lamp base.

14. The lighting device of claim 13, wherein the at least one resistance element is configured as an incandescent filament for emitting light during operation.

15. The lighting device of claim 13, further comprising a light-transmissive lamp bulb within which the at least one semiconductor light source and the at least one resistance element are disposed.

16. The lighting device of claim 13, wherein a reflector for infrared radiation is disposed between the at least one resistance element and the at least one semiconductor light source and arranged to reflect infrared radiation emitted by the at least one resistance element away from the at least one semiconductor light source.

17. The lighting device of claim 13, further configured as a motor vehicle lamp.

18. The lighting device of claim 1, wherein the at least one semiconductor light source comprises a plurality of semiconductor light sources; and the at least one resistance element is connected in series with the plurality of semiconductor light sources.

19. The lighting device of claim 18, wherein the plurality of semiconductor light sources comprises a first group of semiconductor light sources connected in series with one another and a second group of semiconductor light sources connected in series with one another.

20. The lighting device of claim 19, wherein the first group of semiconductor light sources connected is connected in parallel with the second group of semiconductor light sources.

* * * * *